US009826802B2

(12) United States Patent
Barier et al.

(10) Patent No.: US 9,826,802 B2
(45) Date of Patent: Nov. 28, 2017

(54) DEVICE FOR ATTACHING A PIECE OF JEWELLERY, PARTICULARLY AN EARRING

(71) Applicant: ASSI MECA SA, Delemont (CH)

(72) Inventors: Sebastien Barier, Ezanville (FR); Daniel Abou Assi, Delemont (CH)

(73) Assignee: ASSI MECA SA, Delemont (CH)

( * ) Notice: Subject to any disclaimer, the term of this patent is extended or adjusted under 35 U.S.C. 154(b) by 0 days.

(21) Appl. No.: 14/486,380

(22) Filed: Sep. 15, 2014

(65) Prior Publication Data

US 2015/0272286 A1 Oct. 1, 2015

(30) Foreign Application Priority Data

Mar. 28, 2014 (FR) ..... 14 52748

(51) Int. Cl.

| | |
|---|---|
| ***F16B 13/08*** | (2006.01) |
| ***F16B 13/04*** | (2006.01) |
| ***A44C 7/00*** | (2006.01) |
| ***A44C 15/00*** | (2006.01) |

(52) U.S. Cl.

CPC ..... *A44C 7/003* (2013.01); *A44C 15/0035* (2013.01); *Y10T 24/41* (2015.01)

(58) Field of Classification Search

CPC ..... A44C 7/003; A44C 15/0035; A44C 7/007; A44C 7/006; A44C 7/001; A44B 5/002; A44B 9/16; A44B 9/18

USPC ..... 24/705, 97, 114.11, 102 PL, 102 FC

See application file for complete search history.

(56) References Cited

U.S. PATENT DOCUMENTS 632,540 A * 9/1899 Sampson ..... B29C 73/14 138/98
951,459 A * 3/1910 Shupe ..... G09F 3/14 223/102
1,973,282 A * 9/1934 Brush ..... A44C 7/007 63/14.5
2,149,132 A * 2/1939 Carison ..... A44B 5/002 24/102 PL
2,161,189 A * 6/1939 O'Brien ..... A44B 5/002 24/102 R
2,197,882 A * 4/1940 Simpson ..... A44B 5/002 24/102 R
2,267,684 A * 12/1941 Kreisler ..... A44B 5/00 24/102 FC
2,461,845 A * 2/1949 Osterberg ..... A44B 5/002 24/100

(Continued)

FOREIGN PATENT DOCUMENTS

FR 2881032 A1 * 7/2006 ..... A44C 7/00

*Primary Examiner* — Robert J Sandy
*Assistant Examiner* — Jason W San
(74) *Attorney, Agent, or Firm* — Young & Thompson

(57) ABSTRACT

The earring device (1) includes: a shaft (2) suitable for passing through the orifice; a catch (3) hinged with the shaft, the catch being suitable for adopting an unlocked position, wherein the catch is aligned with the shaft and a plurality of locking positions (17) along the shaft, wherein the catch is arranged transversely relative to the shaft; elements (17, 31, 32, 33) for reversibly locking the catch in one of the locking positions. The device makes it possible to adapt the earring to the thickness of the ear wearing same. The device is also suitable for other parts of the body liable to be pierced for the purposes of visual appeal.

12 Claims, 1 Drawing Sheet

(56) References Cited

U.S. PATENT DOCUMENTS 2,516,732 A * 7/1950 Taegtstroem ..... A44B 5/002 24/97
2,519,511 A * 8/1950 Stelter ..... F16B 13/0808 411/342
2,519,821 A * 8/1950 Burr, Jr. ..... A44B 5/002 24/97
2,540,145 A * 2/1951 Stevens ..... F22B 37/223 220/243
2,565,391 A * 8/1951 Molat ..... F16B 13/0808 411/342
2,597,887 A * 5/1952 Meeker ..... A44B 5/002 24/102 PL
2,710,511 A * 6/1955 Baldwin ..... A44C 7/007 63/14.7
2,733,629 A * 2/1956 Vogt ..... E04D 13/0725 248/48.1
2,859,501 A * 11/1958 Pero ..... A44B 1/18 24/598.5
2,860,395 A * 11/1958 Anderson ..... A44B 5/002 24/114.11
2,867,022 A * 1/1959 Chiappinelli, Jr. .... A44B 5/002 24/102 PL
2,885,756 A * 5/1959 Meeker ..... A44B 5/002 24/97
2,908,196 A * 10/1959 Apfelzweig ..... F16B 13/0808 411/344
3,080,630 A * 3/1963 Paliotta ..... A44B 5/002 24/101 R
3,109,229 A * 11/1963 Cataldi ..... A44B 5/00 24/97
3,119,161 A * 1/1964 McNeill ..... A44B 5/002 24/100
3,414,945 A * 12/1968 Spalding ..... A44B 5/002 24/90.5
3,418,699 A * 12/1968 Feldman ..... A44B 5/002 24/90.5
3,688,350 A * 9/1972 Feldman ..... A44B 5/002 24/90.5
4,997,327 A * 3/1991 Cira ..... F16B 13/0808 411/340
5,201,197 A * 4/1993 Bakker ..... A44C 7/003 63/12
5,716,179 A * 2/1998 Smith ..... F16B 13/0808 411/340
6,105,392 A * 8/2000 Biagi ..... A44C 7/001 63/12
6,884,012 B2 * 4/2005 Panasik ..... F16B 13/0833 411/29
7,547,171 B2 * 6/2009 McDuff ..... A47G 1/20 29/525.02
8,353,653 B2 * 1/2013 Guthrie ..... A63B 29/024 411/340
D691,914 S * 10/2013 Barier ..... D11/88
8,584,361 B2 * 11/2013 McFerren ..... A44C 7/001 24/587.1
8,985,877 B1 * 3/2015 Brewer ..... F16B 2/18 396/419
9,394,932 B2 * 7/2016 McDuff ..... F16B 13/003
2004/0079110 A1 * 4/2004 Cappiello ..... A44C 7/003 63/12
2012/0096897 A1 * 4/2012 Bailey ..... A44C 7/00 63/12
2012/0328392 A1 * 12/2012 Difante ..... F16B 13/0808 411/342
2013/0098107 A1 * 4/2013 Barier ..... A44C 7/002 63/12
2014/0017031 A1 * 1/2014 Prichard ..... F16B 13/0808 411/204
2016/0333906 A1 * 11/2016 Varga ..... F16B 2/065
2016/0356297 A1 * 12/2016 Zavodnick ..... F16B 13/0808
2016/0373851 A1 * 12/2016 Prelogar ..... H04R 1/1016

* cited by examiner

DEVICE FOR ATTACHING A PIECE OF JEWELLERY, PARTICULARLY AN EARRING

BACKGROUND OF THE INVENTION

Field of the Invention

The invention relates to the field of jewellery, notably jewellery inserted via a body piercing, particularly an earring.

Description of the Related Art

Earrings generally have one size envisaged to fit, insofar as possible, all shapes and sizes of ears. However, ears can have shapes and sizes that can vary significantly; as such, such earrings rarely fit perfectly, such that, for example, the piece of jewellery decorating same is supported poorly and may adopt an unattractive position.

BRIEF SUMMARY OF THE INVENTION

The aim of the invention is particularly that of providing a device for attaching a piece of jewellery via an orifice created in the body, particularly an earring device, suitable for providing enhanced support of the jewellery on the ear.

According to the invention, such a device for attaching a piece of jewellery via a through orifice created in the body, particularly an earring device, consists of:

a shaft suitable for passing through the orifice;

a catch hinged with the shaft, the catch being suitable for adopting an unlocked position, wherein the catch is aligned with the shaft and a plurality of locking positions along the shaft, wherein the catch is arranged transversely relative to the shaft;

means for reversibly locking the catch in one of the locking positions.

Advantageously, this device further comprises means for reversibly locking the catch in the unlocked position thereof.

The catch may comprise a bolt and elastic means for holding the bolt in contact against the shaft, the shaft may comprise housings for receiving the bolt, the locking means being suitable for comprising the housings, the bolt and the elastic means. In this way, when the bolt is engaged in one of the housings, according to the position of the housing on the shaft, the catch is held in the unlocked position thereof or in one of the corresponding locking positions. A force greater than a locking force applied to the bolt by the elastic means makes it possible to extract the bolt from the housing thereof.

Preferably, the catch is in the shape of a bead held in contact, preferably rolling, against the shaft by the elastic means. The housings may be transverse notches relative to a direction of travel of the bolt along the shaft.

BRIEF DESCRIPTION OF THE DRAWINGS

Some embodiments and alternative embodiments will be described hereinafter, as non-limiting examples, with reference to the appended figures wherein.

DETAILED DESCRIPTION OF THE PREFERRED EMBODIMENTS

Figure 1:
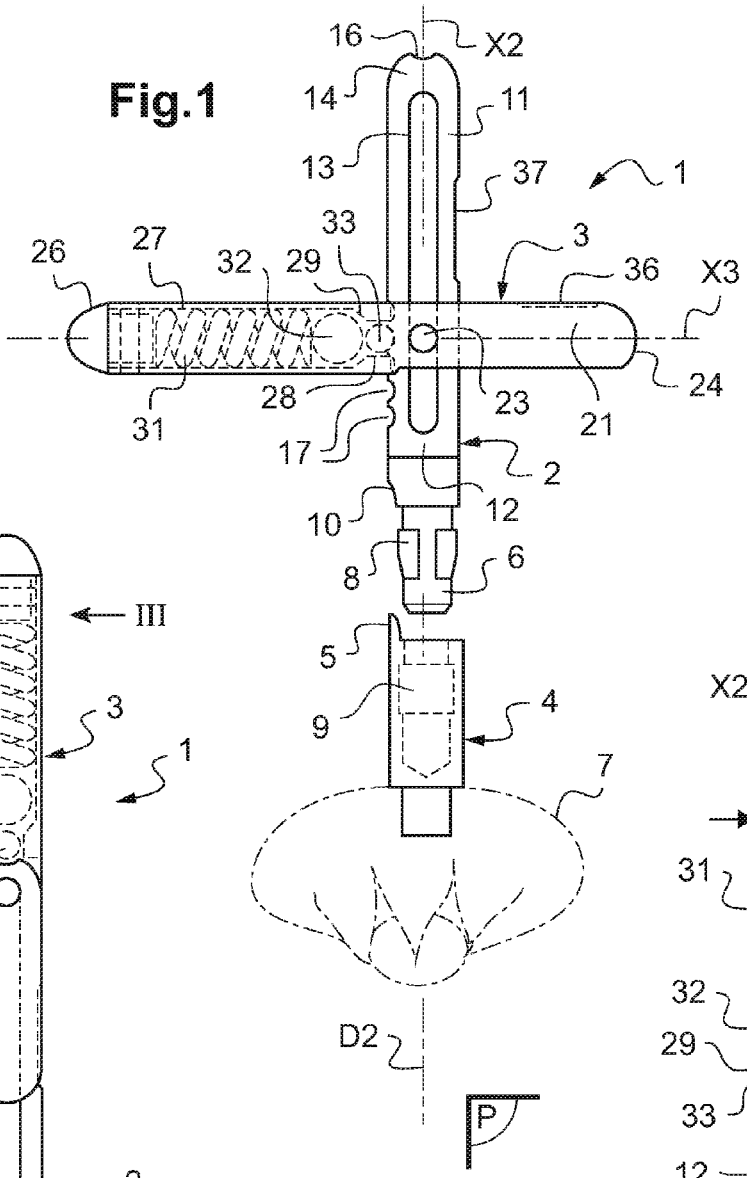
FIG. 1 is a schematic, partially transparent view of a device according to the invention for an earring, in a locking position.

The figures illustrate an earring device 1 comprising a shaft 2, envisaged to pass through the ear of a person wearing the earring, and a catch 3, envisaged to hold the earring on the ear. FIG. 1 further illustrates a mount 4 for a piece of jewellery 7, designed separately, and envisaged to be attached to an attachment head 6 formed at the front of the shaft 2.

Figure 2:
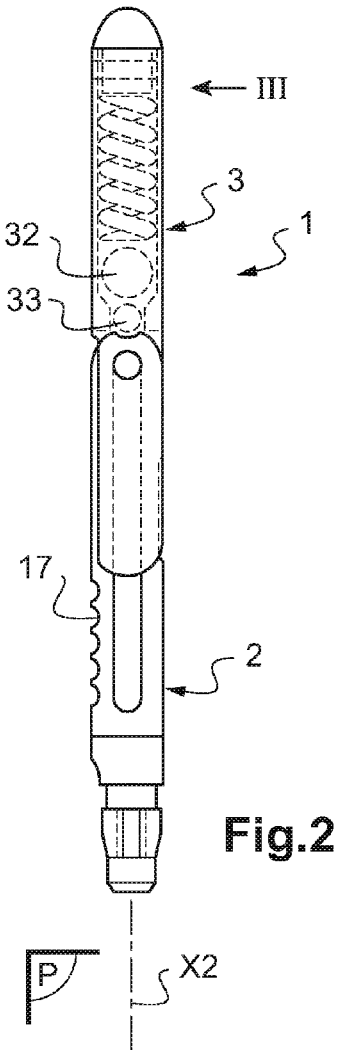
FIG. 2 is a schematic view similar to that in FIG. 1, of the device in FIG. 1, in the unlocked position thereof; and, FIG. 3 is a view along III of the device in the position in FIG. 2.

The device 1, regardless of the position thereof, particularly an unlocked position or a locking position, is substantially symmetrical relative to a plane P, which is that in FIGS. 1 and 2.

In the position in FIG. 1, the catch 3 is arranged transversely to the shaft, such that when the shaft is inserted through the ear, the catch arranged behind the ear, prevents the accidental removal of the earring fitted with the device 1.

An example of a piece of jewellery decorating the earring, is represented schematically in dot and dash lines in FIG. 1; attached to the mount 4, preferably by soldering, it helps, with the catch, hold the earring on the ear, the ear being engaged between the piece of jewellery 7 and the catch 3. A guide pin 5 extending to the rear of the mount 4 is provided to engage with a complementary shape 10 of the head 6, in order to ensure the correct positioning of the piece of jewellery 7 in relation to the device 1.

The head 6 of the shaft 2 is equipped with a spring ring 8 provided for fastening inside a housing 9 of the mount 4, in order to attach the piece of jewellery 7 to the shaft 2. A flat bar 11 extends from the head to the rear, along a direction X2. The bar 11 comprises two faces 12 parallel with each other and with the plane of symmetry P; the bar forms an oblong slot 13 passing through the bar from one face 12 to the other face 12 and extends along the direction X2. The rear end 14 of the bar 11, opposite the head 6, has a circular shape, in the plane of FIG. 1. An end notch 16 is formed in said end. Five side notches 17 are formed in a left lateral edge (in the position in FIGS. 1 and 2) of the bar 11. The notches are closer to the head 6 than the rear end 14. The notches are portions of cylinders.

The catch 3 extends longitudinally along an axis X3, substantially merged with the direction X2 when the device is in the unlocked position thereof. It has a substantially cylindrical shape having a diameter D3.

The catch 3 comprises a first part, on the right in FIG. 1, forming a cap 21 consisting of two flanges 22 (see FIG. 3) between which the bar 11 is slidably mounted. A stud 23 is borne by the cap 21, at a distance from the longitudinal ends 24, 26 of the catch 3, particularly at a distance from a first longitudinal end 24 forming a free and open end between the two flanges 22, of the cap 21.

The catch 3 comprises a second part, on the left in FIG. 1, forming a cylindrical housing 27. The housing 27 is closed on the side of the second longitudinal end 26, longitudinally opposite the first longitudinal end 24. On the other side, on the side of the stud 23, the second part comprises a cylindrical passage 28 having a smaller diameter than that of the housing 27; a tapered neck 29 joins the housing 27 and the passage 28. The housing 27 contains a ball 32 and a helical spring 31 arranged to push back the ball 32 towards the neck 29. The catch 3 further comprises a bead 33, housed in the passage 28, and held pressed against the shaft 2 by the ball 32, under the action of the spring 31.

A bridge 36 connects the two flanges 22, near the first end 24 of the catch 3. The bridge is envisaged to be inserted into a recess 37 provided in a right edge of the shaft, in order to abut against same; in this way, when the catch is in the unlocked position, the second part cannot tip to the right, due to the abutment of the bridge 36 in the recess 37, but merely to the left, i.e. in the position illustrated in FIG. 1.

Figure 3:
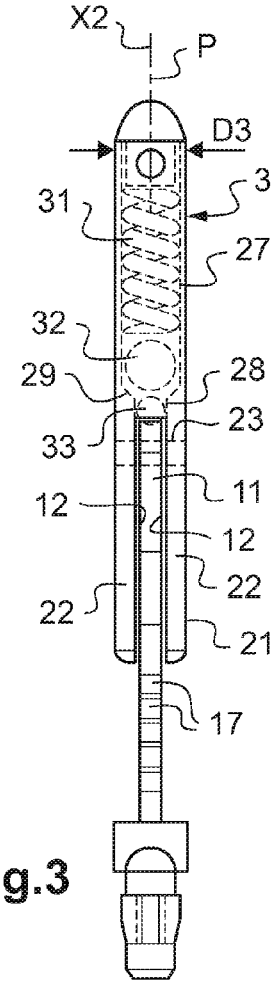

When the device 1 is in the unlocked position in FIGS. 2 and 3, the bead engaged with the rear notch 16; it is held there by the ball 32, under the pressure applied by the spring 31, such that the catch remains naturally aligned with the shaft, facilitating the positioning of the earring through the ear. Rotating the catch to the left, about the rear end 14 of the shaft and the stud 23 in the slot 13, requires the bead to move up along one side of the rear notch 16, applying force against the action of the spring, pushing back the ball 32 towards the second end 26 of the catch 3 until the bead 33 comes out of the notch 16.

The rotation may be continued until the catch is substantially perpendicular to the shaft, and, followed by a translation of the catch 3 along the shaft 2 and towards the head 6, guided by the stud 33 engaged in the slot 13. During this translation, the bead 33 first engages with the rearmost of the side notches 17; if the translation is continued towards the head 6, the bead engages with one and then the other of the following side notches 17. Each time, the bead comes out of the notch with which it is engaged, moving up along one side of this notch, as such applying a force against the action of the spring, pushing back the ball 32 towards the second end 26 of the catch 3 until the bead 33 comes out of the notch. Among the side notches 17, the notch enabling the best hold of the ring 1,7 on the ear is chosen, according to ear thickness and the visual appeal and comfort sought.

The catch 3 and the notches 16, 17 are designed such that during normal use of the earring, the bead continues to remain engaged with the chosen notch, with the force required of the user of the earring to release the bead from a notch not being excessive.

In the example illustrated, in the unlocked position in FIGS. 2 and 3, the shaft and the catch are substantially inscribed in a cylinder having a diameter D3 of 0.95 mm.

Obviously, the invention is not limited to the examples described herein.

In this way, unlike the embodiment described above, the cap may be formed by the shaft and the flat bar may be formed by the catch.

A device according to the invention is also particularly advantageous, because the catch remains rigidly connected to the shaft and thus cannot be misplaced.

The invention claimed is:

1. A device for attaching a piece of jewelry via an orifice created in a human body, the device comprising:
- a shaft suitable for passing through said orifice of the human body;
- a catch that, with the shaft for passing through said orifice, for holding the device on the human body, the catch being movable for selectively adopting i) an unlocked position, wherein the catch is aligned with the shaft, and ii) a plurality of locking positions along the shaft, wherein said catch is arranged transversely relative to said shaft,
- wherein the catch comprises a bead and the shaft comprises plural notches, and
- wherein, in each locking position, said bead is engaged in a resilient way with a corresponding one of the notches.

2. The device according to claim 1, wherein the bead reversibly locks the catch in the unlocked position.

3. The device according to claim 1, wherein,
- the catch further comprises elastic means located within a housing,
- the bead is located within the housing, and
- the elastic means resiliently holds said bead in contact against the corresponding one of the notches of the shaft when in each locking position, and
- said shaft comprises another notch that engages with said bead when the catch is in the unlocked position.

4. The device according to claim 2,
- the catch further comprises elastic means located within a housing,
- the bead is located within the housing, and
- the elastic means resiliently holds said bead in contact against the corresponding one of the notches of the shaft when in each locking position, and
- said shaft comprises another notch that engages with said bead when the catch is in the unlocked position.

5. The device according to claim 1, wherein the bead is located within a housing of the catch, and a spring holds the bead in contact against the corresponding one of the notches of the shaft when in each locking position shaft and against an end of the shaft when in the unlocked position.

6. The device according to claim 2, wherein the bead is bead located within a housing of the catch, and a spring holds the bead in contact against the shaft when in each locking position and when in the unlocked position.

7. The device according to claim 1, wherein,
- the shaft suitable for passing through said orifice of the human body, is further suitable for passing through an ear of the human body, and
- the catch for holding the device on the human body, with the shaft for passing through said orifice, is further for holding the device on the ear.

8. The device according to claim 1, wherein,
- the catch includes a housing,
- each notch of the shaft corresponds to one of the plurality of locking positions along the shaft, and
- the bead is located within the housing of the catch, and a spring that holds the bead in contact against one of the notches of the shaft when the catch is located in a corresponding one of the plurality of locking positions.

9. The device according to claim 2, wherein,
- the catch includes a housing,
- each notch of the shaft corresponds to one of the plurality of locking positions along the shaft, and
- the bead is located within the housing of the catch, and a spring that holds the bead in contact against one of the notches of the shaft when the catch is located in a corresponding one of the plurality of locking positions.

10. The device according to claim 1, wherein,
- the catch further comprises elastic means located within a housing,
- the bead is located within the housing, and
- the elastic means resiliently holds said bead in contact against the corresponding one of the notches of the shaft when in each locking position, and
- said shaft comprises another notch located at an end of the shaft that engages with said bead when the catch is in the unlocked position.

11. A device for attaching a piece of jewelery via an orifice created in a human body, the device comprising:
- a shaft (2) suitable for passing through said orifice of the human body, the shaft comprising i) a front with an attachment head (6), ii) a bar (11) extending along a length of the shaft from the head to a rear end (14) of the shaft, the bar having a first face and a second face that therebetween define a slot (13) extending from the head to the rear end of the shaft, iii) notches (17) formed in a lateral edge of the bar, the notches being closer to the head than the rear end of the shaft;

a catch (3) that, with the shaft for passing through said orifice, for holding the device on the human body, the catch extending in a length direction, the catch having a first longitudinal end (24), a second longitudinal end (23), a cap (21) at the first longitudinal end, wherein the cap is formed by two flanges (22) and has a free and open end between the two flanges, a stud (23) borne by the cap and extending between the two flanges, a housing (27) located between the stud and the second longitudinal end, the housing containing a spring (31), the housing having a first inside diameter, a passage (28) having a second diameter smaller than the first diameter of the housing, and a bead (33) housed in the passage, the bead being held against the shaft under action of the spring, wherein, the bar (11) of the shaft is slidably mounted between the two flanges (22) of the catch, the catch being movable for selectively adopting i) an unlocked position, wherein the catch is aligned with the shaft, and ii) a plurality of locking positions along the shaft, wherein said catch is arranged transversely relative to said shaft, and in each locking position, said bolt is engaged in a resilient way with a corresponding one of the notches with the bead being held against the corresponding one of the notches under action of the spring.

12. The device of claim 11, further comprising a jewelery mount (4) that attaches to the attachment head at the front of the shaft.

* * * * *